US007141777B1

(12) United States Patent
Brillhart

(10) Patent No.: US 7,141,777 B1
(45) Date of Patent: Nov. 28, 2006

(54) IMAGE TUBE PERFORMANCE REGULATION FOR SECURITY PURPOSES

(75) Inventor: Steven A. Brillhart, Vinton, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/034,570

(22) Filed: Jan. 13, 2005

(51) Int. Cl.
*H01J 31/50* (2006.01)
*H01J 43/30* (2006.01)

(52) U.S. Cl. ..... 250/214 VT; 348/217.1

(58) Field of Classification Search ..... 250/214 VT, 250/207, 330, 483.1; 348/217.1
See application file for complete search history.

(56) References Cited

U.S. PATENT DOCUMENTS

| | | | | |
|---|---|---|---|---|
| 4,755,725 | A * | 7/1988 | Kastendieck et al. | 315/360 |
| 5,495,364 | A * | 2/1996 | Palmer | 359/412 |
| 6,087,660 | A * | 7/2000 | Morris et al. | 250/330 |
| 6,320,180 | B1 * | 11/2001 | Estrera et al. | 250/214 VT |
| 2003/0011706 | A1 * | 1/2003 | Chang et al. | 348/375 |

* cited by examiner

*Primary Examiner*—Thanh X. Luu
*Assistant Examiner*—Suezu Ellis
(74) *Attorney, Agent, or Firm*—RatnerPrestia

(57) ABSTRACT

A security regulated image intensifier system includes an image intensifier, a power supply for providing primary power to the image intensifier, and a controller for controlling multiple operating states of the power supply. A housing is provided for securely containing the image intensifier, the power supply and the controller.

16 Claims, 5 Drawing Sheets

IMAGE TUBE PERFORMANCE REGULATION FOR SECURITY PURPOSES

TECHNICAL FIELD

The present invention relates, in general, to an image intensifier and, more specifically, to a system and method for regulating the operation of an image intensifier to prevent or degrade its performance in the hands of an unauthorized user.

BACKGROUND OF THE INVENTION

Image intensifier devices are used to amplify low intensity light or convert non-visible light into readily viewable images. Image intensifier devices are particularly useful for providing images from infrared light and have many industrial and military applications. For example, image intensifier tubes are used for enhancing the night vision of aviators, for photographing astronomical bodies and for providing night vision to sufferers of retinitis pigmentosa (night blindness).

Examples of three types of image intensifying devices are image intensifier tubes, solid-state CMOS and CCD sensors, and hybrid EBCCD/CMOS (Electronic Bombarded CCD or CMOS sensor).

A current state of the art image intensifier, as an example, is the Generation III (GEN III) image intensifier tube exemplified in U.S. Pat. No. 5,029,963 to Naselli, et al., entitled REPLACEMENT DEVICE FOR A DRIVER'S VIEWER and U.S. Pat. No. 5,084,780 to Phillips, entitled TELESCOPIC SIGHT FOR DAYLIGHT VIEWING. The GEN III image intensifier tube in both cited references is of the type currently manufactured by ITT Corporation, the assignee herein.

An image intensifier tube, or a solid state device, typically includes a photo cathode, a gallium arsenide (GaAs) active layer and a microchannel plate (MCP) positioned within a vacuum housing. Infrared energy, for example, may impinge upon the photo cathode and be absorbed in the GaAs active layer, thereby resulting in generation of electron/hole pairs. The generated electrons are then emitted into the vacuum housing and amplified by the MCP.

Once electrons exit the photo cathode, the electrons are accelerated toward an input surface of the MCP by a difference in potential between the input surface of the MCP and the photo cathode, which may be approximately 300 to 900 volts. As the electrons bombard the input surface of the MCP, secondary electrons are generated within the MCP. The MCP may then generate several hundred electrons for each electron entering the input surface. The MCP is also subjected to a difference in potential between its input surface and its output surface, which is typically about 1100 volts. This potential difference enables electron multiplication in the MCP.

As the multiplied electrons exit the MCP, the electrons are accelerated through the vacuum housing toward a phosphor screen (for example) by yet another difference in potential between the phosphor screen and the output surface of the MCP of approximately 4200 volts.

Accordingly, a power supply is generally used to provide the various potential differences of voltage (such as $V_1$, $V_2 \ldots V_n$) to the image intensifier device. This power supply may be a single integrated unit that provides all the required voltages, or multiple power supplies may be used, as required for the specific application. It will be appreciated, therefore, that as used herein the term "power supply" refers to one integrated unit or multiple units.

The image intensifiers may easily be stolen or lost, thereby allowing them to fall into unfriendly or unauthorized hands. Lost or stolen image intensifiers may also cause problems to manufacturers producing these devices, because image intensifiers are subject to export restrictions.

The present invention addresses this problem and provides several solutions.

SUMMARY OF THE INVENTION

To meet this and other needs, and in view of its purposes, the present invention provides a security regulated image intensifier system. The system includes an image intensifier, a power supply for providing primary power to the image intensifier, and a controller for controlling multiple operating states of the power supply. A housing is included for securely containing the image intensifier, the power supply and the controller. The multiple operating states of the power supply may include at least an ON state and an OFF state, the ON state providing a level of primary power that places the image intensifier in an operational mode, and the OFF state providing another level of primary power that places the image intensifier in a non-operational mode. The multiple operating states of the power supply may also include a degraded operational state for providing yet another level of primary power that places the image intensifier in a degraded operational mode. The multiple operating states of the power supply may further include a destroy state providing still another level of primary power that permanently destroys the image intensifier and places it in a destroyed mode. The controller of the system may include a counter for setting at least one interval of time, and a selector for selecting an operating state of the power supply during the set interval of time, and the power supply may be configured to provide a level of primary power based on the selected operating state for the set interval of time. The system may include an input/output (I/O) module disposed within the housing for interfacing with a control module disposed externally of the housing. The control module may be configured to send data to the controller for controlling the multiple operating states of the power supply.

In another embodiment of the invention, a security regulated image intensifier system includes an image intensifier, supply means for providing primary power to the image intensifier, controlling means for controlling operating states of the supply means, and housing means for securing the image intensifier, the supply means and the controlling means.

In yet another embodiment, the invention includes a method of regulating operational modes of an image intensifier. The method includes the steps of: (a) embedding an image intensifier in a housing having a power supply; (b) controlling operating states of the power supply; and (c) supplying primary power to the image intensifier from the power supply, based on the operating states of the power supply controlled in step (b). Step (b) may include counting at least one interval of time, and selecting an operating state of the power supply during the set interval of time. Step (c) may include supplying at least one level of primary power based on the selected operating state for the set interval of time.

It is understood that the foregoing general description and the following detailed description are exemplary, but are not restrictive, of the invention.

BRIEF DESCRIPTION OF THE DRAWING

The invention is best understood from the following detailed description when read in connection with the accompanying drawing. Included in the drawing are the following figures.

DETAILED DESCRIPTION OF THE INVENTION

Now that electronics have become small, it is possible to incorporate an image intensifier and its power supply (or multiple power supplies) into a single integrated unit or housing. Due to miniaturization of processors, such as microprocessors, microcontrollers, FPGAs, and ASICs, it is also possible to incorporate control logic into the same single integrated unit or housing. With the incorporation of a power supply and control logic into the same unit, it is possible to control the length of time that an image intensifier may function at a full operational capability or a degraded operational capability. The present invention includes such a unit to advantageously prevent unauthorized use of an image intensifier.

Figure 1:
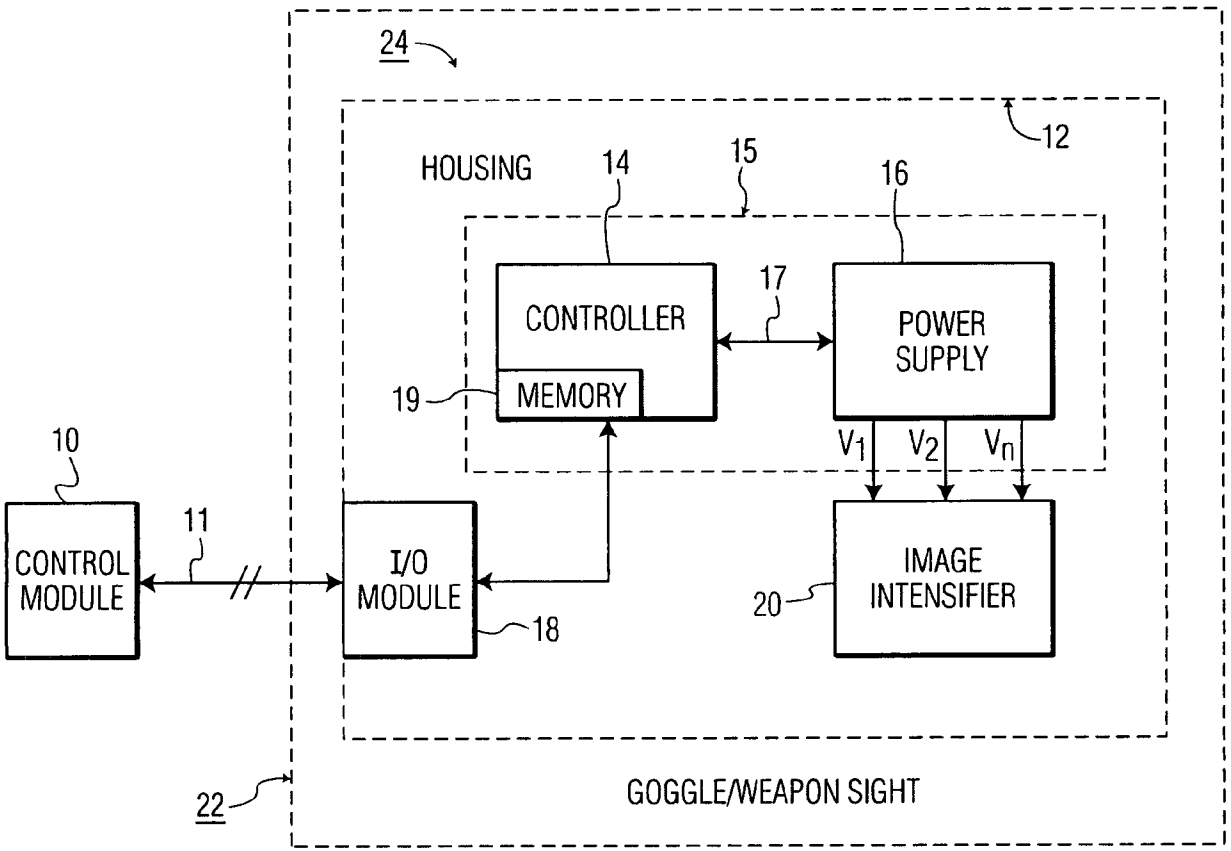
FIG. 1 is a system block diagram of an exemplary security regulated image intensifier system coupled to a control module, in accordance with an embodiment of the present invention.

Referring now to FIG. 1, there is shown an embodiment of the present invention. As shown, security regulated image intensifier system 24 includes controller 14, power supply 16, input output (I/O) module 18 and image intensifier 20, disposed within housing 12. Housing 12 may be any structure that is configured to be tamper-proof unless having authorized access. Housing 12 may also be an encapsulated unit or a completely enclosed unit.

In the embodiment of the present invention shown in FIG. 1, security regulated image intensifier system 24 is disposed within goggle/weapon sight 22 and is providing intensified images when operational. Goggle/weapon sight 22 may be, for example, a night vision goggle or a weapon sight for a soldier. A user control module 10 is also shown communicating with I/O module 18, by way of communication line 11. It will be appreciated that communication line 11 may be a cable, an RF channel, an infrared (IR) channel, or any other communications channel.

Still referring to FIG. 1, power supply 16 may be one unit or more than one unit for providing required voltages or multiple current levels to image intensifier 20. It will be appreciated that power supply 16 may provide one or several different voltages ($V_1$, $V_2$, . . . $V_n$), or it may also provide different current levels, as necessary for the specific application.

When voltages $V_1$, $V_2$, etc., are provided to image intensifier 20 at their respective voltage levels, it will be appreciated that image intensifier 20 is expected to perform in a fully operational state. When the voltages are disabled, it will be appreciated that image intensifier 20 is expected to be in a non-operational state. If one or several combinations of these voltages are set to levels other than their specified levels, image intensifier 20 is expected to be performing in a degraded operational state. Finally, when these voltages are increased to predetermined high levels, image intensifier 20 may be configured to self-destruct, thereby rendering it into a destroyed state. The precise levels of these voltages (or current levels) would, of course, depend on the specific characteristics of the image intensifier disposed within housing 12. These levels may be determined, for example, from the specification of the image intensifier.

Controller 14 provides control signals to power supply 16 by way of control line (or lines) 17. Control line 17 provides enabling/disabling signals to each of the respective voltages outputted by power supply 16. Controller 14 may also provide control signals to power supply 16 to change a voltage level from one amplitude to another amplitude, for example, so that the image intensifier may be placed in a fully operational mode, a degraded mode, a destroyed mode or a non-functional mode. Controller 14 may also set a period of time for each of the set voltage levels.

As an example, voltage $V_1$ may be enabled at a first predetermined voltage level for a first predetermined period of time and, subsequently, changed to provide a second predetermined voltage level for a second predetermined period of time. As an another example, controller 14 may enable all the voltages to operate at their proper voltage levels for a first predetermined period of time and, then disable all the voltages, thereby placing the image intensifier in a non-functional state.

In the exemplified embodiment of the invention, controller 14, including memory 19, may be programmed by way of I/O module 18 from user control module 10. Memory 19 is shown as being part of controller 14 but, of course, may be a separate unit.

After being programmed by control module 10 and having its control program stored in memory 19, control module 10 may be used to initialize security regulated image intensifier system 24. Thereafter, control module 10 may be disconnected from housing 12 and/or goggle/weapon sight 22. In another embodiment of the invention, controller 14 may include firmware that includes a program to control the states of power supply 16 (the power supply states may be defined as including an OFF state, an ON state, a degraded-mode state, and a destroy state; of course other states may also be included). Once initialized, system 24 may step through its various modes of operation without any user intervention, as explained later.

It is contemplated that the present invention provides a housing that completely encompasses I/O module 18, controller 14, power supply 16 and image intensifier 20, so that an unauthorized user will have difficulty obtaining access to the image intensifier. It is also within the scope of this invention that when the security regulated image intensifier system is disposed within goggle/weapon sight 22, the goggle/weapon sight provides additional resistance to user tampering and increases the difficulty in reaching the image intensifier.

Although shown as two separate units within housing 12, it will be appreciated that controller 14 and power supply 16 may be configured within one single integrated unit. Such configuration is shown by dashed lines and is generally designated as module 15.

Figure 2:
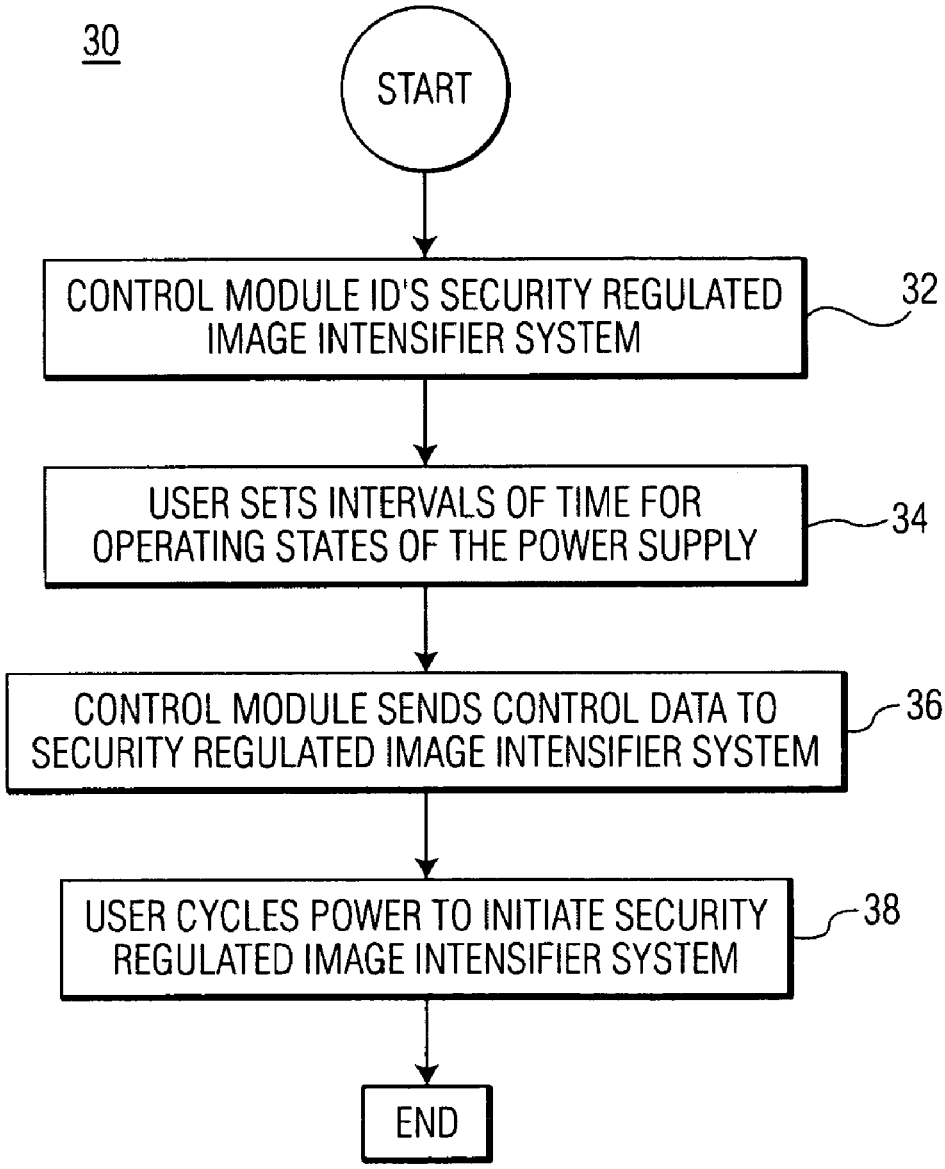
FIG. 2 is a flow diagram of a protocol exchange between the control module and the security regulated image intensifier system of FIG. 1, in accordance with an embodiment of the present invention.

Referring next to FIG. 2, there is shown an exemplary handshaking method between control module 10 and security regulated image intensifier system 24. The handshaking method, generally designated as 30, begins at step 32, in which the control module requests that system 24 identify itself. Such identification may include a model number and a manufacture date of system 24. Other parameters may also be included. The model number, the manufacture date and other parameters used for identifying system 24 may be stored in memory 19.

It is within the scope of the present invention that other identification features may be implemented in step 32. For example, there are known devices in public use that have RF and/or hard coded keys to unlock specific functionalities. The steps used by these known devices may, of course, be incorporated into a specific protocol between control module 10 and system 24 that provides identification. Although not shown, it will be appreciated that control module 10 may include control keys and a display for providing an interface with a user.

After control module 10 identifies system 24, method 30 enters step 34. The step may set the multiple intervals of time required for operating the various states of the power supply. As an exemplary embodiment, the user may set voltage $V_1$ (shown in FIG. 1) to a first predetermined level for a first predetermined time period. Similarly, the user may set $V_2$ to a second predetermined level for a second predetermined time period. If required, the user may set $V_1$ and/or $V_2$ (for example) to still another level (third voltage level) for still another time period (a third predetermined time period).

Method 30 next enters step 36 and sends control data, as programmed by the user, to system 24, so that controller 14 may, in turn, be programmed. After transmission of the control data to system 24, the method enters step 38 and allows the user to cycle power to initialize system 24. Line 11 may now be removed from system 24.

Figure 3A:
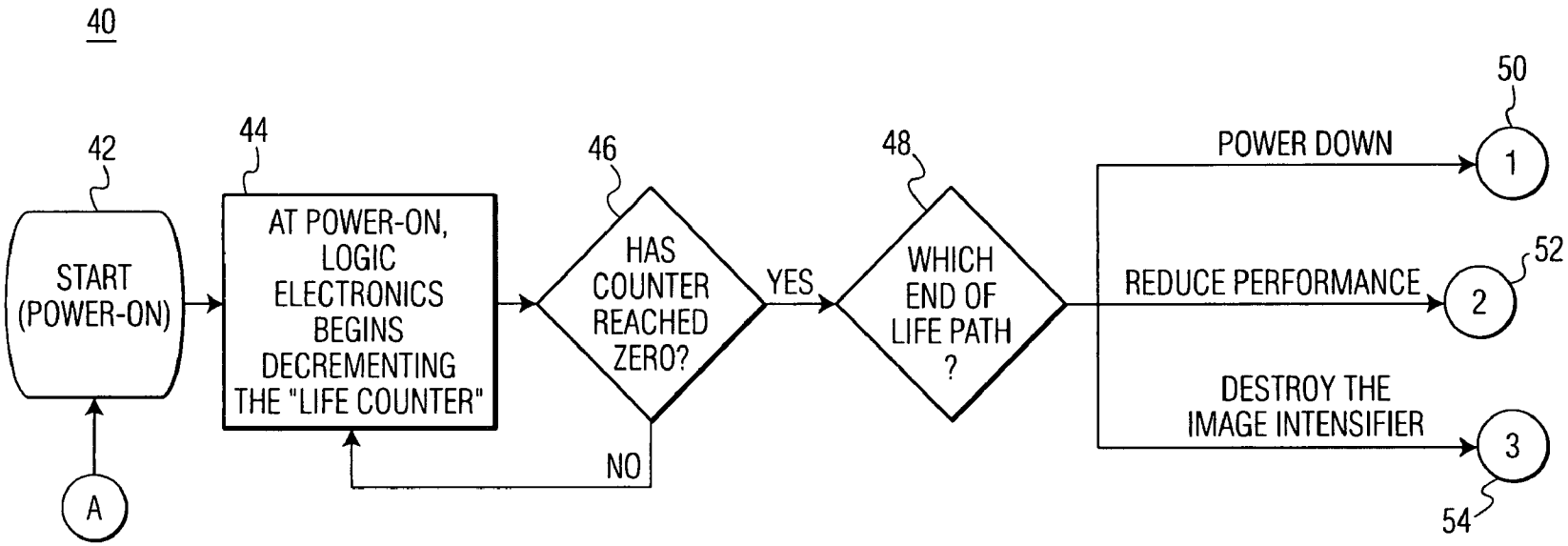
FIGS. 3*a* and 3*b* are flow diagrams depicting steps executed by a controller to security regulate an image intensifier, embodied in the system of FIG. 1, in accordance with an embodiment of the present invention.
Figure 3B:
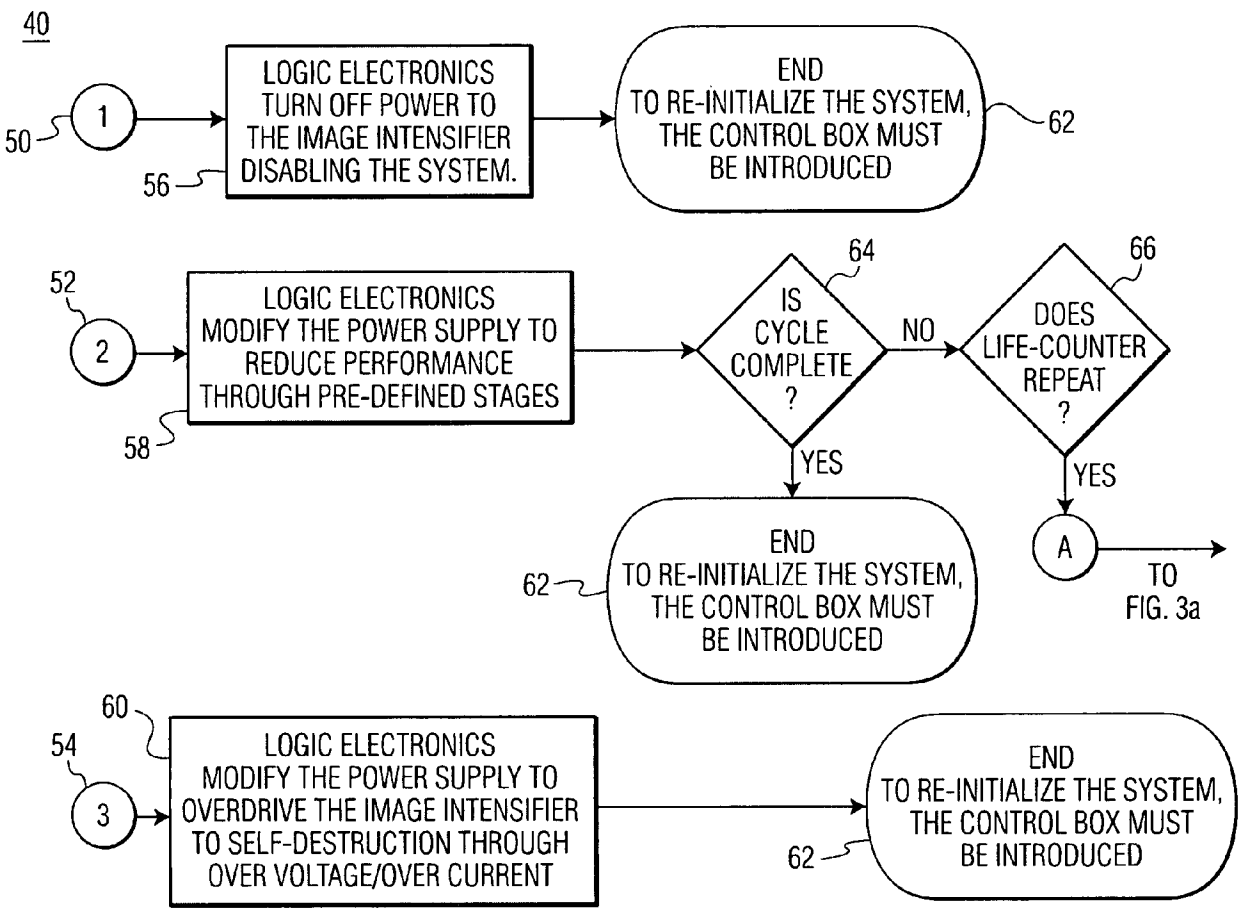

Referring next to FIGS. 3*a* and 3*b*, there is shown an exemplary method used by the security regulated image intensifier system 24 to security regulate image intensifier 20. The method, generally designated as 40, begins at step 42 to initialize system 24 when the system is activated by power-ON. In the embodiment of the invention exemplified in FIG. 2, power-ON begins upon the user disconnecting control module 10 from system 24. After initialization, the method enters step 44 and begins decrementing a counter (or multiple counters). It will be appreciated that each counter may be set to start at a predetermined count value by way of control module 10. For example, the counter may begin at 864,000 seconds (10 days) and may count down by each second, until it reaches a count of zero.

Method 40 then enters decision box 46 to determine whether the counter (or life counter) has reached a count of zero. If the counter has not reached zero, the method branches back to step 44 and continues decrementing its counter. If decision box 46 determines, on the other hand, that the counter has reached zero, the method enters decision box 48.

In another embodiment, method 40 may determine whether the counter has reached a predetermined set point. The predetermined set point may be a value other than zero. If the counter has not reached the predetermined set point, the method branches back to step 44 and continues decrementing its counter. If decision box 46 determines, on the other hand, that the counter has reached a predetermined set point the method enters decision box 48.

It will be appreciated that although steps 44 and 46 are shown as counting down to zero by way of a single counter, the method may include more then one counter. Each counter may be started upon initialization in synchronism with other counters. Each counter may also have a predetermined set period of time which may be different from another counter. Each counter may also increment its count value, instead of decrement its count value.

Depending on the predetermined data sent from control module 10 to controller 14, decision box 48 of method 40 may select any one of three different paths shown in FIG. 3A. As shown, first path 50 may be selected to place image intensifier 20 in a power down mode, or an OFF mode. Second path 52 may be selected to place image intensifier 20 in a reduced performance mode, or a degraded mode. Third path 54 may be selected to place image intensifier 20 into a destroyed mode.

If first path 50 is selected, the method enters step 56 and turns OFF the power provided by power supply 16 to image intensifier 20 (in other words, step 56 places the power supply in an OFF state). In this manner, image intensifier 20 is completely disabled and placed in the OFF mode. The method then branches to step 62 and ends the process. In order to reinitialize the system, control module 10 must be connected to the system, as shown in FIG. 1. Control module 10 may then reprogram system 24 by sending new data to controller 14.

If the second path 52 is selected, the method branches to step 58 and modifies the power supply (places the power supply in a degraded state) to reduce or degrade performance of the image intensifier (places the image intensifier in a degraded operational mode) through one or multiple predetermined cycles. The method may, for example, enable various predetermined power levels which would supply voltage levels (for example) that configure image intensifier 20 into a degraded operational mode. Since the second path may require more than one cycle or counter for counting a corresponding predetermined interval of time, the method may enter step 64 to determine if a respective cycle has been completed. If the method determines that the respective cycle has been completed, the method branches to step 62 and ends its process. In order to reinitialize system 24, the control module must be connected to system 24 for programming.

If the method determines, on the other hand, that the cycle has not yet been completed (or another cycle should begin) the method branches to decision box 66 to determine whether a count cycle should be repeated (or another counter should begin its decrementing of counts). If a count cycle is to be repeated (or another counter is to begin counting), the method loops back to step 42 to start its counting again.

If the third path is selected, the method enters step 60 to modify the power supply (place the power supply in a destroy state) to provide an overdrive voltage to image intensifier 20 in order for the image intensifier to self destruct. The method enters step 62 and ends the process. With this path, of course, the image intensifier is no longer usable and system 24 may require reconstruction (or thrown away), before connecting system 24 again to control module 10 for another programming cycle.

Figure 4:
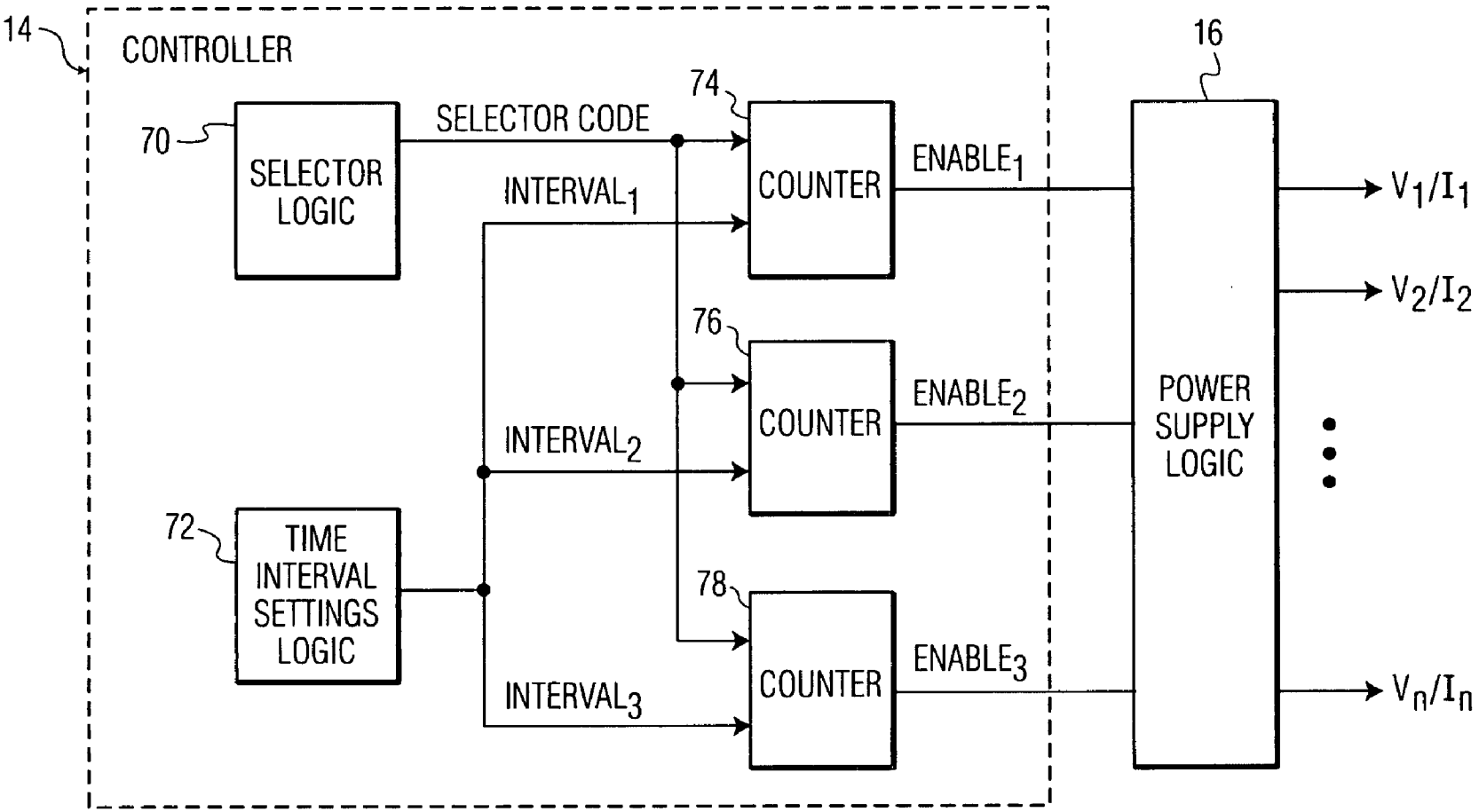
FIG. 4 is a block diagram of exemplary logic, implemented in hardware, firmware or software, executed by the controller of FIG. 1, in accordance with an embodiment of the present invention.

Referring now to FIG. 4, there is shown a block diagram of the logic circuits within controller 14, as they control power supply 16. It will be appreciated that the circuits of controller 14 may be implemented in software, firmware, hardware, or any combination thereof.

As shown, controller 14 includes selector logic 70 and time interval settings logic 72. The selector logic and the time interval settings logic control multiple counters, for example counters 74, 76 and 78. The selector logic may provide a selector code (for example a code of 2 or 3 bits) to determine which of counters 74, 76 and/or 78 are to be selected to respectively begin a countdown cycle. One counter may be selected or more than one counter may be selected.

Time interval settings logic 72 provides a corresponding predetermined interval of time to each counter, so that a respective counter may begin its count-down, or decrementing, from its respective predetermined interval setting. For example, counter 74 may be set to a first predetermined interval of time, counter 76 may be set to a second predetermined interval of time, and counter 78 may be set to a third predetermined interval of time.

While counter 74 is counting down or decrementing its counter, as an example, counter 74 may provide enable 1 to power supply 16. Similarly, while counter 76 is decrementing its count, counter 76 may provide, for example, enable 2 to power supply 16. Finally, while counter 78 is decrementing its count, it may provide enable 3 to power supply 16. Upon reaching a count of zero, a respective counter may stop providing an output signal (enable signal), thereby disabling a respective command to power supply 16.

It will be appreciated that power supply 16 may include logic circuitry, as shown in FIG. 4, so that the power supply may provide one or multiple voltage levels to image intensifier 20. For example, power supply 16 may provide voltages $V_1, V_2, \ldots V_n$. One or more of these voltages may be provided to image intensifier 20, depending on one or a combination of enable signals outputted from the respective counters. For example, if enable 1 is inputted to power supply 16, then voltages $V_1$ and $V_2$ may be supplied to image intensifier 20. Similarly, if enable 2 is inputted to power supply 16, voltages $V_3$ and $V_4$, for example, may be supplied to image intensifier 20. As a further illustration, if enable 3 is provided to power supply 16, the power supply may provide voltage $V_5$ to image intensifier 20. Of course, any other combination may also be programmed into controller 14 and power supply 16. In this manner, combinations of enable signals may control the cycling (turning ON or OFF) of voltage levels provided to power up image intensifier 20. Instead of controller 14 enabling voltages, the controller may also enable various current levels, $I_1, I_2, \ldots I_n$, as shown. In addition, power supply logic 16 may provide a voltage/current whose amplitude level varies as a function of time. When enable 1, for example, enables such a voltage/current, the amplitude level is varied during the enable command.

As another embodiment, the present invention may be configured to use a transmit/receive algorithm. This algorithm may be similar to algorithms used by security badges or security tags in supermarkets. The power supply may be programmed to be "active" for a set period of time (goggle power-ON time). The power supply may contain a countdown timer, accessed through an encoded RF message. Once initiated with a period of time (time may be hard-coded or may be set by an RF signal), the image intensifier may function for a prescribed amount of ON time. Once that time is reached, several events may occur:

a) The power supply may cease functioning (effectively killing the tube) until being reset.

b) The power supply may eliminate the gating function and reduce image intensifier gain to a minimum level (making the image intensifier functionally equivalent to internationally available technology (Gen 2, for example). This may provide some safety to an authorized user who, for some reason, remains on a mission longer than a count-down timer may normally be set for.

c) Any other power-supply functions may be modified accordingly to create a desired reduced, or degraded performance.

d) Utilizing some of the micro-machined mechanical lockouts, the power supply may permanently kill itself.

e) The image intensifier may contain a cascade failure mode which may, after set times, continue to decrease performance offering an elegant, but noticeable warning that time is running out. For example, during the first time period, the goggle may cease gating and reduce gain. After the second time period, gain may be reduced again. At the end of the third time period, the goggle may turn off completely.

f) The power-supply may be commanded, after a predetermined period, into an OVER-DRIVE condition, causing irreparable harm to the image intensifier and preventing any re-potting action.

In an exemplary scenario, prior to a mission, a local maintenance person may enter a desired ON-time into a scanning wand, or similar device. Each goggle is, in turn, presented to the device. The device sends a query signal to the goggle, which replies with its serial number. The wand, using an on-board database (similar to the Red Crosses SSN lookup table for eligible donation dates) may decode the encoded information and transmit an activation code to the goggle which may reset the counter to a specified time.

The image intensifier may be set to an overdrive condition after a predetermined set period. Alternatively, the image intensifier may be set to a predetermined time between forced-failures. The image intensifier (and/or goggles) may then have to be rotated through a depot-level maintenance shop to be reset. This may be a more secure method, but may involve more risk (goggles may need to be cycled more frequently to ensure they do not cut-off during a mission).

As another embodiment, the present invention may be used to "deactivate" or power-OFF image intensifier systems during storage, using radio or hard-coded keys. Prior to fielding the system, the present invention may be used to activate or power-ON the system. This embodiment prevents use of an image intensifier stolen from a storage facility, or taken without authorization during transit.

Although the security regulated device of the present invention is shown operating in conjunction with securing an image intensifier, the present invention may be used to secure or regulate other types of sensitive devices.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A security regulated image intensifier system comprising:

an image intensifier, a power supply for providing primary power to the image intensifier, a controller for controlling multiple operating states of the power supply, and a housing for securely containing the image intensifier, the power supply and the controller, wherein the controller is configured to automatically set at least one interval of time for controlling an operating state of the multiple operating states of the power supply, the controller includes a counter for setting at least one interval of time, and a selector for selecting an operating state of the power supply during the set interval of time, and the power supply is configured to provide a level of primary power based on the selected operating state for the set interval of time.

2. The security regulated image intensifier system of claim 1 wherein the multiple operating states of the power supply includes at least an ON state and an OFF state, the ON state providing a level of primary power that places the image intensifier in an operational mode, and the OFF state providing another level of primary power that places the image intensifier in a non-operational mode.

3. The security regulated image intensifier system of claim 2 wherein the multiple operating states of the power supply includes a degraded operational state for providing yet another level of primary power that places the image intensifier in a degraded operational mode.

4. The security regulated image intensifier system of claim 2 wherein the multiple operating states of the power supply includes a destroy state providing still another level of primary power that permanently destroys the image intensifier and places it in a destroyed mode.

5. The security regulated image intensifier system of claim 1 wherein the counter sets at least two intervals of time, and the selector selects different operating states of the power supply during the at least two intervals of time.

6. The security regulated image intensifier system of claim 5 wherein the operating states of the power supply includes an OFF state and at least one of an ON state, a degraded operational state and a destroy state, and the OFF state places the image intensifier in a non-operational mode, the ON state places the image intensifier in an operational mode, the degraded operational state places the image intensifier in a degraded operational mode, and the destroy state destroys the image intensifier.

7. The security regulated image intensifier system of claim 1 including an input/output (I/O) module disposed within the housing for interfacing with a control module disposed externally of the housing, the control module configured to send data to the controller for controlling the multiple operating states of the power supply.

8. The security regulated image intensifier system of claim 7 wherein the data sent to the controller includes instructions for counting a length of an interval of time corresponding to at least one of the operating states of the power supply.

9. The security regulated image intensifier system of claim 7 wherein the control module is configured to identify the security regulated image intensifier system, prior to sending the data to the controller.

10. The security regulated image intensifier system of claim 1 wherein one of a night vision goggle or a weapon sight includes the housing.

11. A security regulated image intensifier system comprising:

an image intensifier, supply means for providing primary power to the image intensifier, controlling means for controlling operating states of the supply means, and housing means for securing the image intensifier, the supply means and the controlling means, wherein the controlling means is configured to automatically set at least one interval of time for controlling an operating state of the operating states of the supply means, the controlling means includes counting means for setting at least one interval of time, and selecting means for selecting an operating state of the supply means during the set interval of time, and the supply means is configured to provide at least one level of primary power based on the selected operating state for the set interval of time.

12. The security regulated image intensifier system of claim 11 wherein the operating states of the supply means includes an OFF state and at least one of an ON state, a degraded operational state and a destroy state, and the OFF state places the image intensifier in a non-operational mode, the ON state places the image intensifier in an operational mode, the degraded operational state places the image intensifier in a degraded operational mode, and the destroy state destroys the image intensifier.

13. The security regulated image intensifier system of claim 11 including input/output (I/O) means disposed within the housing means for communicating with a control module disposed externally of the housing means, the control module configured to send data to the controlling means for controlling the operating states of the power supply.

14. A method of regulating operational modes of an image intensifier comprising the steps of:

(a) embedding an image intensifier in a housing having a power supply;

(b) automatically controlling operating states of the power supply by setting at least one interval of time corresponding to at least one of the operating states; and (c) supplying primary power to the image intensifier from the power supply, based on the operating states of the power supply controlled in step (b);

wherein step (b) includes counting at least one interval of time, and selecting an operating state of the power supply during the set interval of time, and step (c) includes supplying at least one level of primary power based on the selected operating state for the set interval of time.

15. The method of claim 14 wherein selecting the operating state of the power supply includes selecting an OFF state and at least one of an ON state, a degraded operational state and a destroy state, and the OFF state places the image intensifier in a non-operational mode, the ON state places the image intensifier in an operational mode, the degraded operational state places the image intensifier in a degraded operational mode, and the destroy state destroys the image intensifier.

16. The method of claim 14 wherein step (b) includes counting at least one interval of time, and selecting an operating state of the power supply for the at least one interval of time.

* * * * *